US007037074B2

(12) United States Patent
Hoshino

(10) Patent No.: US 7,037,074 B2
(45) Date of Patent: May 2, 2006

(54) LIGHTWEIGHT, FOLDABLE, AND REPLACEABLE FABRIC FAN BLADES

(75) Inventor: Kiyo Hoshino, Chesterfield, MO (US)

(73) Assignee: Emerson Electric Co., St. Louis, MO (US)

( * ) Notice: Subject to any disclaimer, the term of this patent is extended or adjusted under 35 U.S.C. 154(b) by 65 days.

(21) Appl. No.: 10/751,705

(22) Filed: Jan. 5, 2004

(65) Prior Publication Data

US 2005/0147494 A1 Jul. 7, 2005

(51) Int. Cl.
*F01D 5/00* (2006.01)

(52) U.S. Cl. ..... 416/62; 416/132 A; 416/240

(58) Field of Classification Search ..... 416/5, 416/62, 207, 209, 208, 226, 219 R, 132 A, 416/70 A, 70 R, 240, 132 R; 135/117, 119, 135/128, 24; 296/97.7, 97.8; 297/184
See application file for complete search history.

(56) References Cited

U.S. PATENT DOCUMENTS

| | | | | |
|---|---|---|---|---|
| 4,676,721 A * | 6/1987 | Hardee | 416/146 R |
| 4,815,784 A | 3/1989 | Zheng | 296/97.7 |
| 4,889,543 A * | 12/1989 | Burt | 95/286 |
| 5,110,261 A | 5/1992 | Junkin | 416/204 R |
| 5,462,407 A * | 10/1995 | Calvo | 416/132 A |
| 5,516,264 A | 5/1996 | Anetrini | 416/62 |
| 5,591,006 A | 1/1997 | DeMeo et al. | 416/62 |
| 5,947,686 A | 9/1999 | Keyes | 416/61 |
| 6,015,261 A | 1/2000 | Barone | 416/62 |

* cited by examiner

*Primary Examiner*—Edward K. Look
*Assistant Examiner*—Dwayne J White
(74) *Attorney, Agent, or Firm*—Locke Liddell & Sapp LLP

(57) ABSTRACT

A ceiling fan assembly is provided having a frame defining a plurality of fan blades, a replaceable one-piece fabric covering attached to the frame, and a frame holder that supports and positions the frame and attaches it to a fan motor. The fabric covering may be used to provide a visual display such as decoration or advertising.

58 Claims, 7 Drawing Sheets

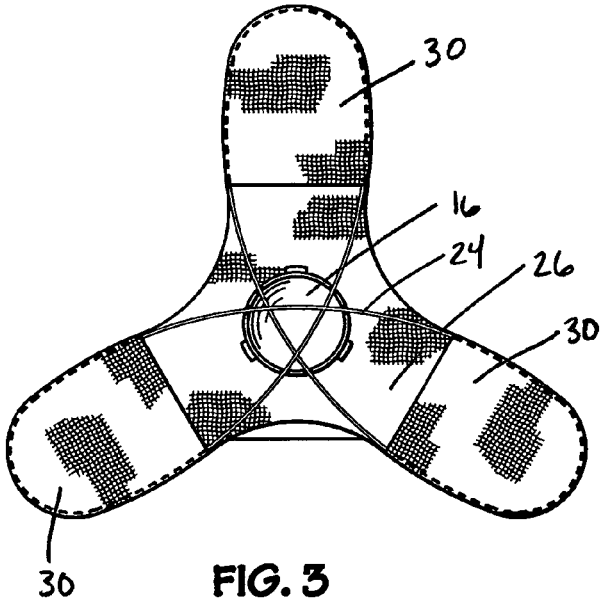
FIG. 3
FIG. 4
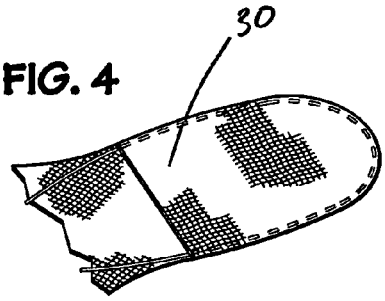
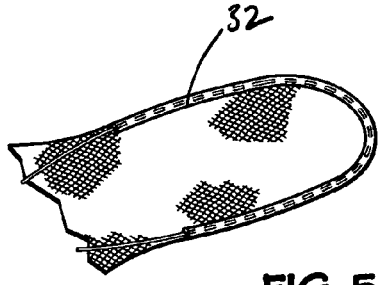
FIG. 5

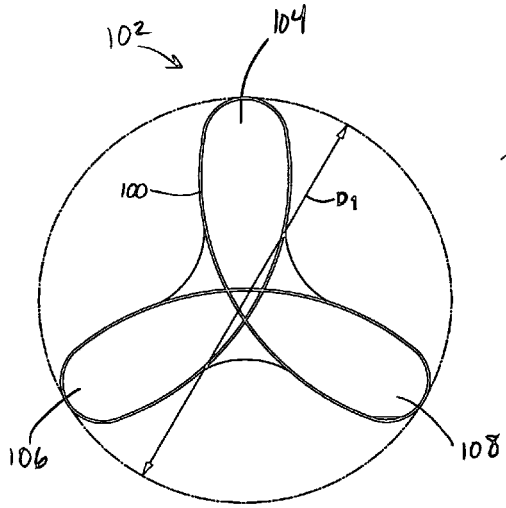
FIG. 6
FIG. 7
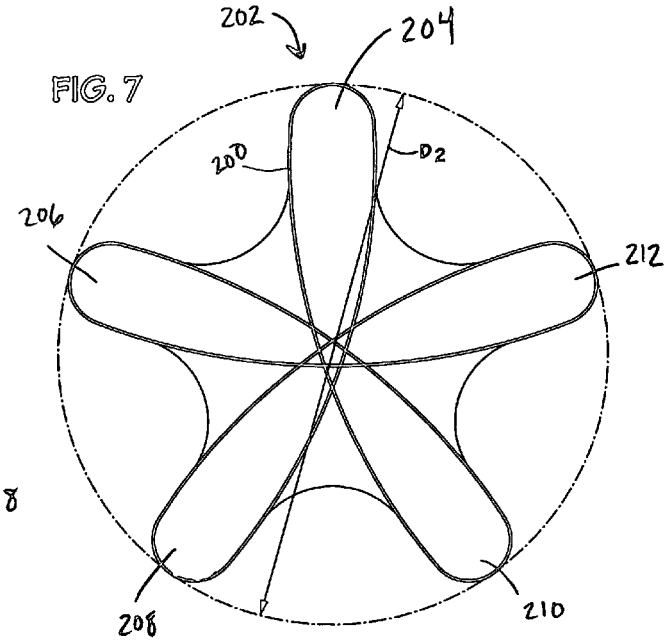

LIGHTWEIGHT, FOLDABLE, AND REPLACEABLE FABRIC FAN BLADES

BACKGROUND OF THE INVENTION

The present disclosure relates generally to an improved ceiling fan assembly including lightweight, replaceable fabric ceiling fan blades.

Ceiling fans have relatively large blades, typically ranging from 36 to 52 inches, and usually ranging in number from three to five, all depending on the model of ceiling fan and motor. Each of the blades has a relatively flat cross-section that is angled relative to horizontal so that rotation in one direction will draw air downwardly and rotation in the other direction will draw air upwardly. Each of the blades is connected to the shaft of a fan motor via a connection member that connects with the inboard end of a blade and has an arm that connects with the shaft. Typically, ceiling fan blades are constructed of wood, but many are also constructed of other materials, including one or more polymeric materials.

It is known in the art that a ceiling fan can be customized by replacing each blade with another blade having a different color or design. Several companies also offer products that allow the user to further "decorate" ceiling fan blades in order to match a particular room decor. For example, U.S. Pat. No. 5,516,264 describes a ceiling fan slipcover that consists of a fitted case for each blade that has a selected color, pattern, or 18 design. Although this provides for the customization of ceiling fan blades, it has many drawbacks. First, it requires one slip cover for each blade. This not only increases the manufacturing costs for covering the several blades on each fan, but also decreases the performance and speed of the fan due to the additional weight on each blade. Second, the centrifugal forces created by the motion of the fan constantly acts to remove the slipcovers, thus requiring significant retaining measures to abate the risk of imbalancing the fan due to loss of a slipcover.

What is needed is a ceiling fan blade that provides the customization advantages of the prior art, while overcoming the prior art's shortcomings.

SUMMARY OF THE INVENTION

A ceiling fan assembly is provided having a flexible and foldable frame made of tempered spring steel defining a plurality of blades, a replaceable one-piece fabric covering attached to the loops and defining a plurality of fan blades, and a frame holder that supports and positions the frame and attaches to a fan motor. In one embodiment, the covering is attached to the frame using a plurality of pockets that fittingly engages the plurality of loops. The fabric material is preferably stretchable, and is more preferably composed of a spandex material. The frame holder is constructed with pre-defined grooves sufficient to support and position the frame.

A method for displaying a visual display such as decoration for a home, office, or a special event is also provided. The fabric covering may include features such as colors, letters, numbers, words, pictures, symbols, designs, or any combinations thereof. The covering is replaceable with a new covering, thereby changing the visual display. Advertising for a product or service may also be provided. An advertiser provides a ceiling fan assembly as described herein for locations frequented by the public such as restaurants, bars, or other types of stores. The advertiser may then periodically send a new covering for the ceiling fan assembly to the place of business, thereby changing the advertisement for the product or service.

BRIEF DESCRIPTION OF THE DRAWINGS

A more complete understanding of the present disclosure may be obtained with reference to the accompanying drawings:

FIG. 3 shows the top view of the frame member with the covering attached and relative to the frame holder.

FIG. 4 shows a first embodiment for attaching the fabric to the frame member.

FIG. 5 shows a second embodiment for attaching the fabric to the frame member.

FIG. 6 shows a frame member having three blades and having effective diameter $D_1$.

FIG. 7 shows a frame member having five blades and having effective diameter $D_2$.

DESCRIPTION OF ILLUSTRATIVE EMBODIMENTS

The subject matter of the present disclosure will now be described more fully with reference to the accompanying drawings in which a preferred embodiment is shown. This disclosure may, however, be embodied in many different forms and should not be construed as being limited to the embodiments set forth herein.

Figures 1, 2B:
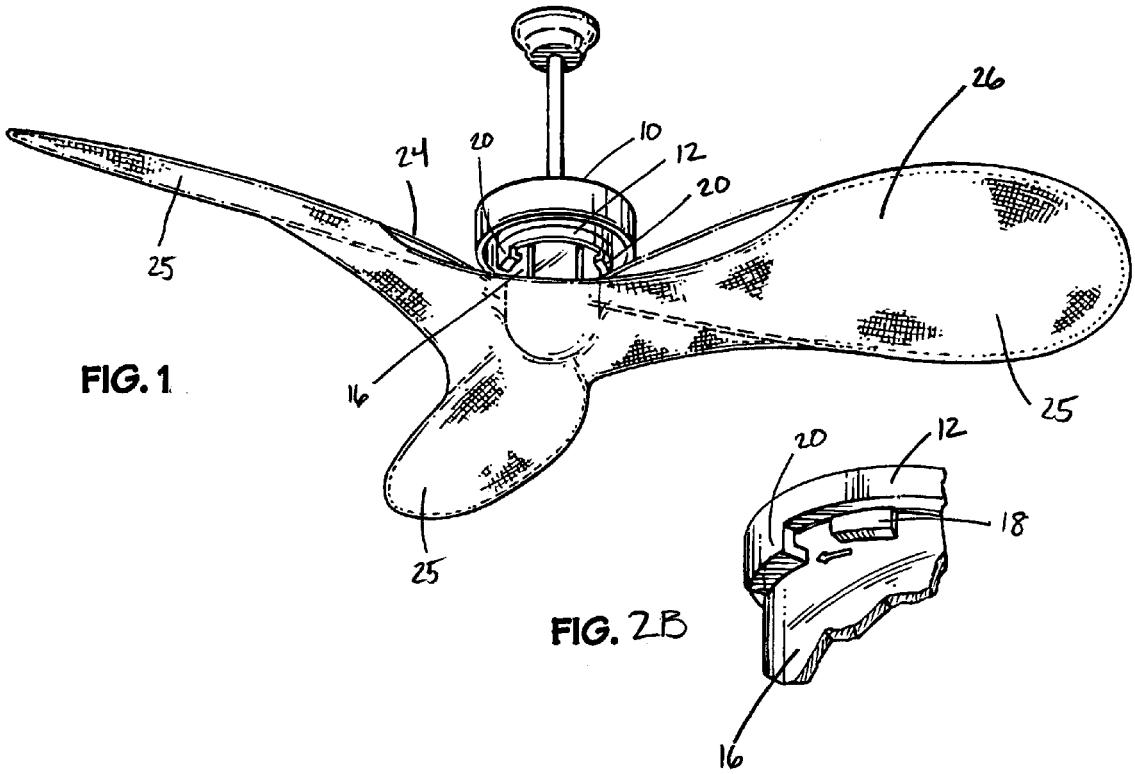
FIG. 1 shows a perspective view of a ceiling fan assembly in accordance with the present disclosure.
FIG. 2B shows a cutaway view of the latching mechanism for the frame holder.
Figure 2A:
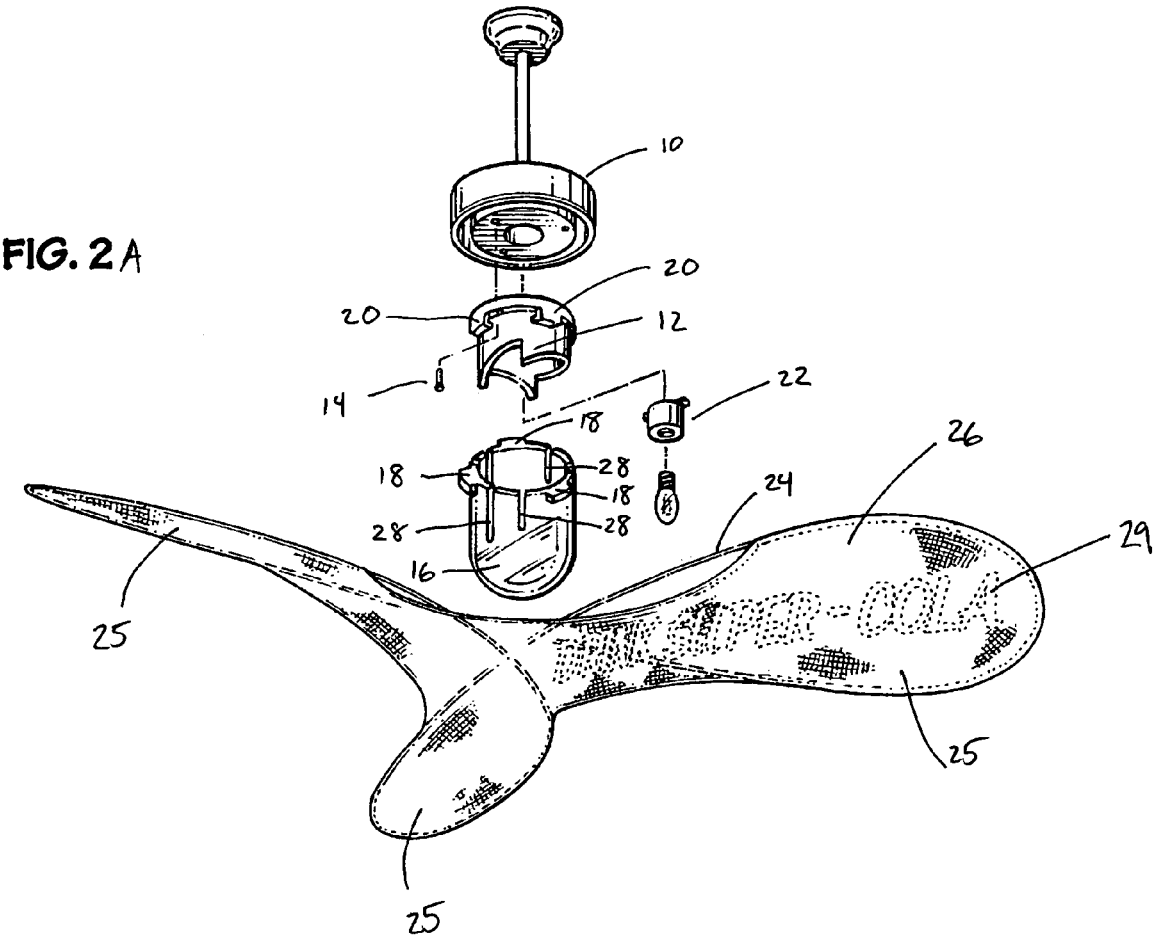
FIG. 2A shows an exploded view of the ceiling fan assembly of FIG. 1.

Referring to FIGS. 1 and 2A, a ceiling fan assembly is shown in accordance with certain teachings of the present disclosure. The ceiling fan mount and motor (collectively 10) receives cover holder 12, which is attached by screws 14 or any other attaching means known in the art. The cover holder 12 is designed to receive frame holder 16, which attaches to cover holder 12 by twisting frame holder 16 such that its plurality of locking tabs 18 are engaged by the corresponding locking grooves 20 of cover holder 12. This locking motion is best shown in the FIG. 2B cutaway. Optionally, a lighting fixture 22 may be attached to fan mount 10 and positioned within frame holder 16 and cover holder 12. For this reason, frame holder 16 is preferably constructed of a material conducive for emitting light, such as non-opaque glass or plastic.

Frame member 24 is preferably a single piece of tempered spring steel that is easily bendable and foldable. The tempered spring steel frame when unfolded provides a symmetrical plurality of loops that define a plurality of ceiling fan blades. Fabric 26 is constructed preferably in a one-piece design and is sized to substantially cover the plurality of loops of frame member 24 so as to form a plurality of fan blades 25 that directly corresponds to the plurality of loops.

Frame holder 16 is designed with a plurality of frame guides or grooves 28 sized to receive and orient frame 24 such that the resultant fan blades 25 are angled relative to horizontal so that rotation in one direction will draw air downwardly and rotation in the other direction will draw air upwardly.

Other flexible metal or plastic frames may be utilized in accordance with the principles of the present disclosure, but one skilled in the art will realize that such alternate materials may alter the flexibility/rigidity of the frame relative to tempered spring steel. It is preferred that frame member 24 be flexible enough to easily align within frame guides 28 of frame holder 16, yet rigid enough to hold its fan blade shape both during fan operation and when idle. It is also preferred that frame member 24 be flexible enough to fold the frame into a plurality of smaller concentric and substantially circular or oval loops that is compact for packaging, storage, shipping, and other business considerations. A foldable frame such as this is described in more detail in U.S. Pat. No. 4,815,784 (herein incorporated by reference in its entirety), which discloses the use of flexible materials for windshield sun shades that are collapsible in a manner similar to the compact storage mode provided in the present disclosure.

Fabric covering 26 is preferably made of a spandex material, or any other material suitable for stretching the fabric tightly over frame member 24. Alternatively, fabric 26 may be made of any material suitable for covering the frame and moving air during operation of the fan. Such alternative materials include, but is not limited to, cotton-based materials, paper-based materials, and polymer-based materials (such as polyethylene films and polyesters), however these materials may require additional features for attaching tightly to the frame.

FIGS. 3–5 illustrate two alternative methods for attaching fabric 26 to frame 24. In FIGS. 3 and 4, a pocket or envelope 30 is used to attach fabric 26 to the assembly by encompassing each blade within a corresponding pocket 30. In FIG. 5, a more permanent method for attaching is depicted where a band 32 is created about the periphery of the fabric at each blade so as to receive at least a portion of each blade of frame member 24. Band 32 can be created using any means known in the art, including sewn stitches, buttons, snaps, velcro, etc. In both embodiments, fabric 26 is properly sized and tightly stretched over frame member 24 in such a way as to substantially minimize movement of fabric 26 during operation of the ceiling fan. One of skill in the art should appreciate that other alternative methods for attaching fabric 26 to frame 24, including but not limited to clasps, ties, elastic bands, tabs (secured by Velcro, snaps, buttons, etc.), or other mechanical means. Although not depicted in the figures, fabric 26 may also be constructed with an opening in its center to provide space for frame holder 16 to emerge through the fabric, thus providing direct light if the optional lighting package is utilized.

Figure 8:
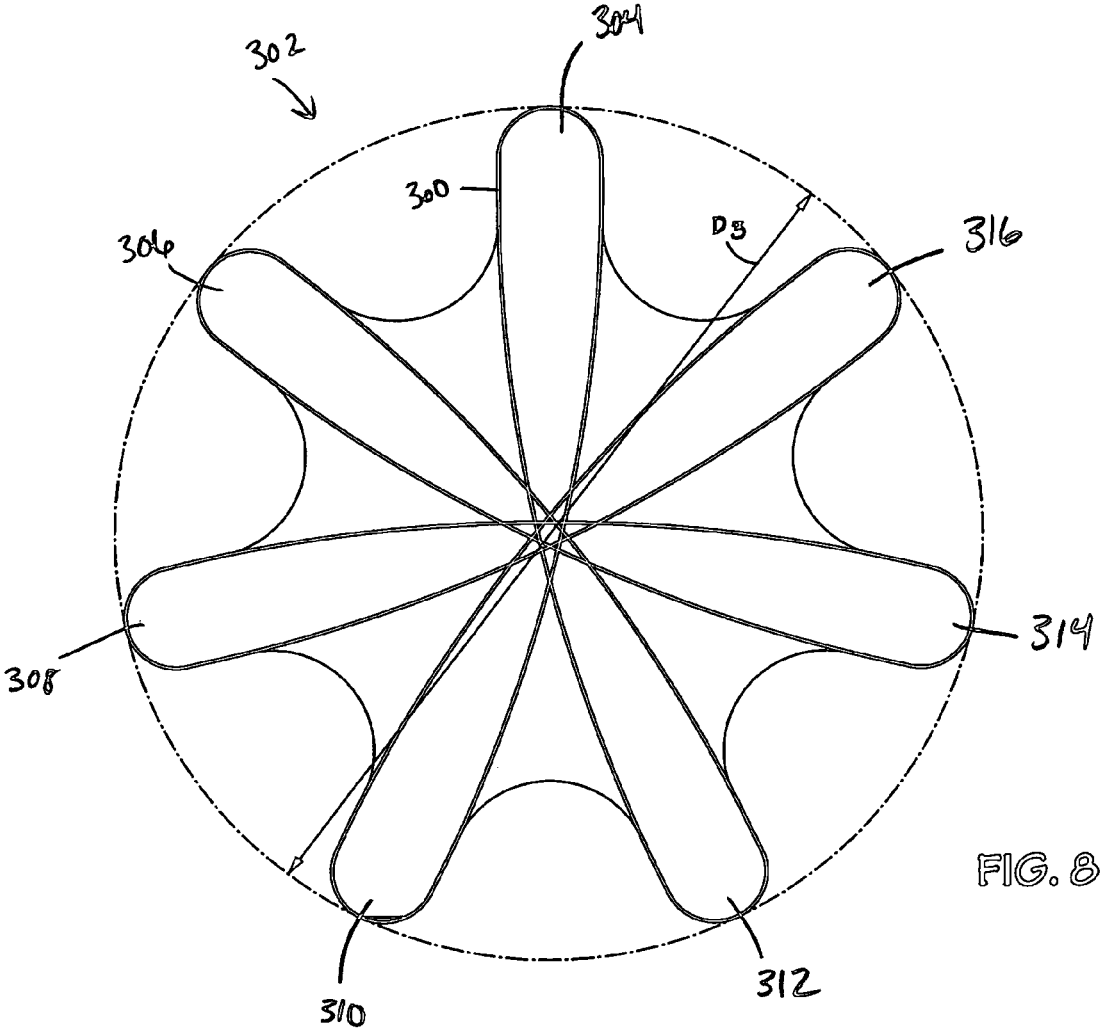
FIG. 8 shows a frame member having seven blades and having effective diameter $D_3$.

Turning now to FIGS. 6–8, three different embodiments of ceiling fan blade assemblies are generally shown. FIG. 6 shows frame 100 forming a ceiling fan blade assembly 102 having three fan blades 104, 106, and 108. Ceiling fan blade assembly 102 has an effective diameter $D_1$, where $D_1$ is preferably 60 inches. In this regard, the "effective" diameter $D_1$ constitutes the diameter of a circle circumscribed about the ceiling fan assembly 102. FIG. 7 shows frame 200 forming a ceiling fan blade assembly 202 having five fan blades 204, 206, 208, 210, and 212. Ceiling fan blade assembly 202 has an effective diameter $D_2$, where $D_2$ is preferably 80 inches. FIG. 8 shows frame 300 forming a ceiling fan blade assembly 302 having seven fan blades 304, 306, 308, 310, 312, 314, and 316. Ceiling fan blade assembly 302 has an effective diameter $D_3$, where $D_3$ is preferably 100 inches. One skilled in the art should appreciate that a large number of combinations of number of blades and effective diameters can be achieved by utilizing the teachings of the present disclosure. One of skill in the art should appreciate that frame holder 16 would need to be configured with an appropriate number of frame grooves 28 to adequately receive and position a specific frame having a specific number of blades.

FIGS. 6–8 also illustrate an important advantage of the present disclosure. Each ceiling fan assembly (i.e. the frame covered by fabric) is significantly lighter weight than traditional ceiling fan blade assemblies typically found today having wooden or plastic fan blades. The disclosed assembly either requires a smaller fan motor, uses less power to operate at a given speed, or operates at a higher speed than is typically found in traditional ceiling fans today. Also, lighter weight systems such as those described herein provide for a larger number of fan blades than today's traditional three, four, or five blade models, and with longer effective diameters than what is typically used today. More blades, longer blades, and increased speed all result in increased air movement, which ultimately equates into reduced energy costs for the consumer.

Figure 9:
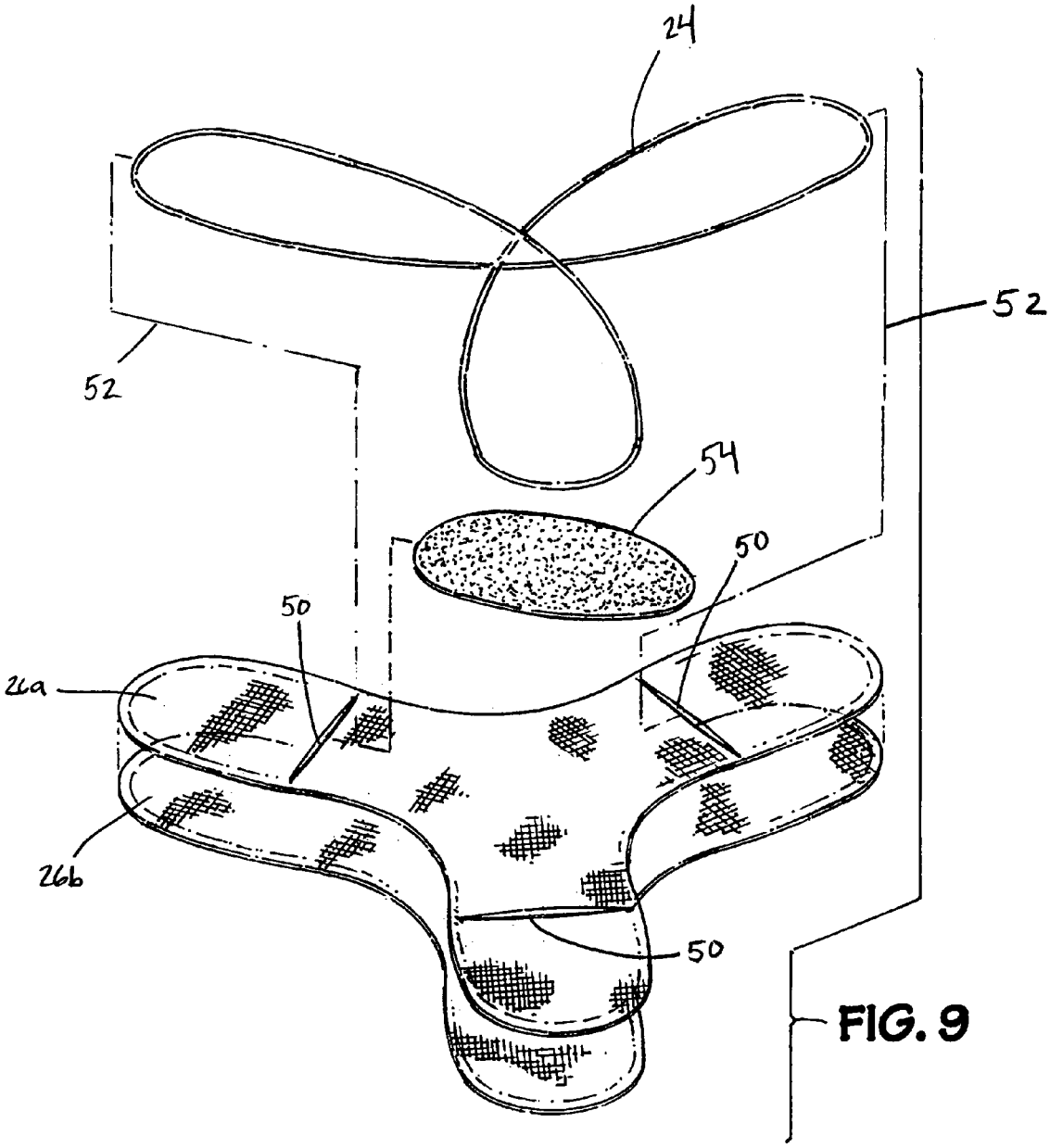
FIG. 9 shows an exploded view of a ceiling fan blade assembly in accordance with the present disclosure.
Figure 10:
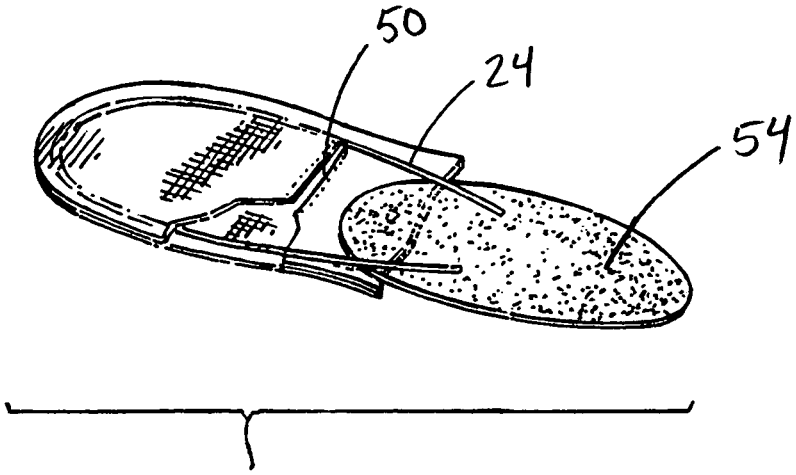
FIG. 10 shows a cutaway of a single frame blade with covering attached and filter inserted.
Figure 11:
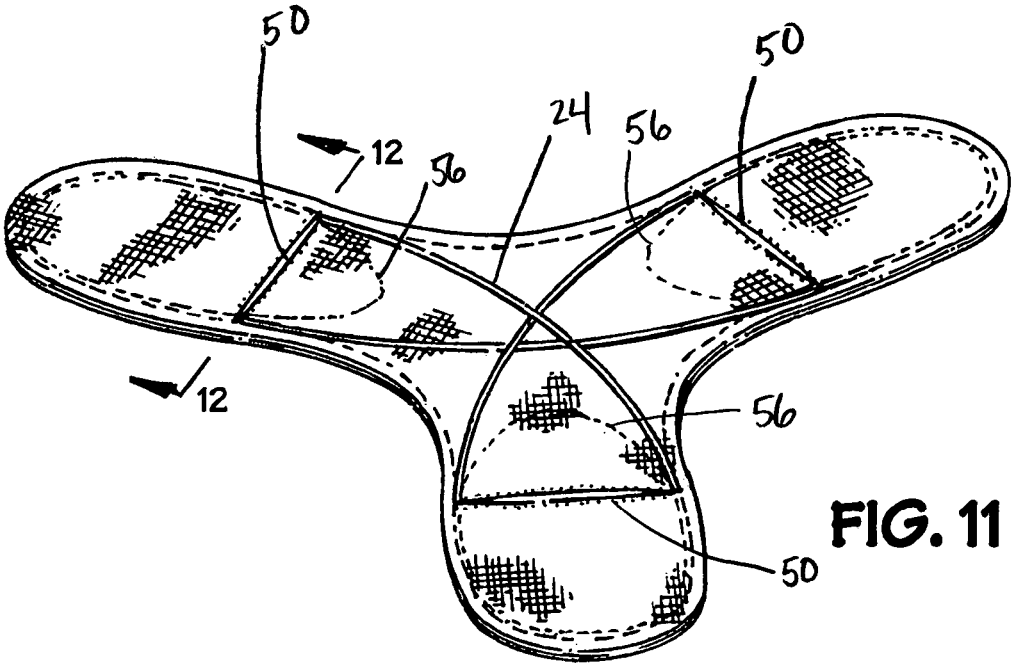
FIG. 11 shows the ceiling fan blade assembly of FIG. 9 assembled.
Figure 12:
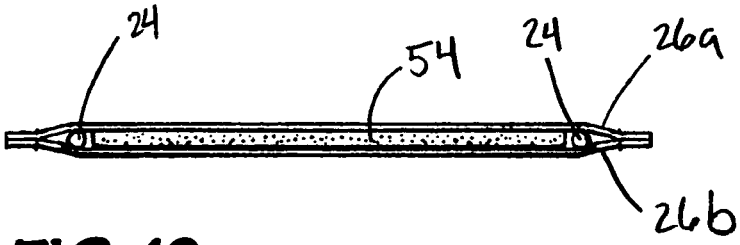
FIG. 12 shows a cross-sectional view of a single fan blade of FIG. 11.

FIGS. 9–12 provide more specific details for a preferred embodiment of the present disclosure. As shown in FIG. 9, the "one-piece" fabric described above is actually constructed of two individual pieces of fabric 26*a* and 26*b* attached together (such as by sewing). The top piece 26*a* is formed with slits 50 that form a pocket or envelope when piece 26*a* is attached to piece 26*b*. Each pocket is sized so as to receive a loop of frame 24, as is shown by broken lines 52 in FIG. 9. Additionally, air filter 54 may be inserted into the sleeve as well to remove dust during the operation of the ceiling fan assembly. Air filter 54 is preferably constructed from paper or felt materials, and is designed so as to fit snugly within the sleeve along with frame 24, as is best shown in FIG. 12. Alternatively or in combination with air filter 54, a separate insert (not shown) may also be inserted into the sleeve that acts to deodorize the room during operation of the ceiling fan. Such a deodorizing insert may be constructed from paper, for example, steeped in a deodorant. Alternatively, air filter 54 and the deodorizing insert can be combined into a single insert composed of an air filter having been steeped in a deodorant. It is also preferred that any insert, whether it is an air filter, deodorizer, or combination, be constructed so that it can be fully enclosed between pieces 26*a* and 26*b*, as is best shown by the phantom lines 56 in FIG. 11, thereby hiding slit 50 from the look-up view.

Another advantage of the present disclosure is the reduction of imbalancing caused by uneven weight distribution amongst the fan blades. This is typically caused in today's ceiling fans by warped blades, damaged blade mounting brackets, or, as described above, a lost slipcover on one blade. The lightweight nature of the ceiling fan assemblies described herein provides little bias towards a particular blade. Also, the flexible frame, the dome cover, and the stretchable fabric provide a consistently uniform and symmetrical shape during operation, which minimizes the possibility of imbalance.

Yet another advantage of the present disclosure relates to its alternate utility as a visual display. The ceiling fan covering can be used to provide custom decorating for a ceiling fan located in a home, office, place of business, or at a special event such as a birthday party or reception. The visual display may be created by providing different fabric materials sewn together to form the fabric covering or by applying printing onto the fabric by any means known in the art, including but not limited to screen printing, direct printing, and transfer printing. Typically, the visual display will include features such as colors, letters, numbers, words, pictures, symbols, designs, or any combination of the above. By replacing the fabric covering on the ceiling fan assembly, the new covering can be used to change the visual display. As an illustration, a ceiling fan in a home can have a first fabric covering having colors and designs that match the decor of the room, such as a wall color or a curtain design. However, a new fabric covering having festive colors and designs and the message "Happy Birthday!" can be used instead, for example, for a child's fifth birthday party. Yet another fabric covering can be used during holidays, such as Christmas for example, to convey a festive theme.

Fabric coverings in accordance with the present disclosure can also be used to advertise in locations frequented by the public. For example, advertising contained on the covering may promote a company, a product, or an event such as a concert, the Super Bowl, or a charity event. An example of such advertising includes printing a product slogan on the covering, as shown in FIG. 2A at 29 ("Drink Super Cola"). Examples of locations where such advertising may be effective includes restaurants, bars, grocery stores, department stores, sporting goods stores, or any other facility open to the public where such advertising may be effective. By replacing the fabric covering on the ceiling fan assembly, a new covering can be used to change the advertising. For example, a fabric covering on a ceiling fan at a bar may contain advertising for a beer company. However, a new fabric covering can be used to advertise for a contest being sponsored by the bar. Yet another fabric covering can be used prior to a major sporting event to advertise drink specials or other promotionals. Furthermore, a manufacturer of goods or services may effectuate such advertising by providing, by mail for example, new coverings to the owners of such locations so that the owner can change the advertisement as described herein.

It will be apparent to one of skill in the art that described herein is a novel lightweight, replaceable fabric ceiling fan blade assembly. Also described herein is a novel method for using such a ceiling fan assembly to provide a visual display and to advertise. While the invention has been described with references to specific preferred embodiments, it is not limited to these embodiments. The invention may be modified or varied in many ways and such modifications and variations as would be obvious to one of skill in the art are within the scope and spirit of the invention and are included within the scope of the following claims.

What is claimed is:

1. A ceiling fan assembly, comprising:

one continuous frame member defining a plurality of ceiling fan blades;

a one-piece covering secured to the frame member to form a plurality of ceiling fan blades; and a frame holder that secures the frame member to a fan motor.

2. The assembly of claim 1, wherein the frame member is comprised of a flexible material.

3. The assembly of claim 1, wherein the frame member is foldable into a compact form.

4. The assembly of claim 1, wherein the frame member is comprised of tempered spring steel.

5. The assembly of claim 1, wherein the covering is comprised of a fabric material.

6. The assembly of claim 5, wherein the fabric material is stretchable.

7. The assembly of claim 5, wherein the fabric material is comprised of spandex.

8. The assembly of claim 5, wherein the fabric material is comprised of a material selected from cotton, paper, or a polymeric film.

9. The assembly of claim 1, wherein the covering includes a plurality of pockets that fittingly engages the frame member.

10. The assembly of claim 1, wherein the covering includes a plurality of tabs for connecting the covering to the frame member.

11. The assembly of claim 1, wherein the covering includes a band about the periphery of the covering that engages the frame member.

12. The assembly of claim 11, wherein the band is sewn into the covering.

13. The assembly of claim 1, wherein the frame holder comprises pre-defined grooves for accepting and positioning the frame member relative to the fan motor.

14. The assembly of claim 1, wherein the number of fan blades is selected from three, five, or seven.

15. The assembly of claim 1, wherein the length of each fan blade is approximately the same.

16. The assembly of claim 1, wherein the effective diameter of the frame member is in the range of from about 40 inches to about 120 inches.

17. The assembly of claim 1, further comprising a removable air freshener attached to the covering.

18. The assembly of claim 17, wherein the air freshener is concealed within a pocket of the covering.

19. The assembly of claim 1, further comprising an air filter attached to the covering.

20. The assembly of claim 19, wherein the air filter is concealed within a pocket of the covering.

21. The assembly of claim 1, wherein there is printing on the covering.

22. The assembly of claim 1, wherein the covering is decorated with features selected from colors, letters, numbers, words, pictures, symbols, designs, or any combinations thereof.

23. The assembly of claim 1, wherein the covering provides advertising for a company, a product, or an event.

24. A cover for a ceiling fan, comprising:

a one-piece covering material attachable to a frame member;

the covering material shaped to define a plurality of ceiling fan blades when attached to the frame member.

25. The cover of claim 24, wherein the covering is comprised of a fabric material.

26. The cover of claim 24, wherein the fabric material is stretchable.

27. The cover of claim 24, wherein the fabric material is comprised of spandex.

28. The cover of claim 24, wherein the fabric material is comprised of a material selected from cotton, paper, or a polymeric film.

29. The cover of claim 24, wherein the covering includes a plurality of pockets for fittingly engaging the frame member.

30. The cover of claim 24, wherein the covering includes a plurality of tabs for connecting the covering to the frame member.

31. The cover of claim 24, wherein the frame member is defined by one continuous frame member comprised of a flexible material.

32. The cover of claim 31, wherein the covering includes a band about the periphery of the covering that engages the frame member.

33. The cover of claim 32, wherein the band is sewn into the covering.

34. The cover of claim 24, wherein there is printing on the covering.

35. The cover of claim 24, wherein the covering material is decorated with features selected from colors, letters, numbers, words, pictures, symbols, designs, or any combinations thereof.

36. The cover of claim 24, wherein the covering material provides advertising for a company, a product, or an event.

37. The cover of claim 24, wherein the covering further comprises a pocket for the insertion of an air freshener.

38. The cover of claim 24, wherein the covering further comprises a pocket for the insertion of an air filter.

39. A ceiling fan blade assembly, comprising one continuous frame member defining a plurality of ceiling fan blades wherein the frame member is comprised of tempered spring steel.

40. The assembly of claim 39, wherein the frame member is comprised of a flexible material.

41. The assembly of claim 39, wherein the frame member is foldable into a compact form.

42. The assembly of claim 39, further comprising a frame holder for attaching the frame member to a ceiling fan motor.

43. The assembly of claim 42, wherein the frame holder comprises pre-defined grooves for positioning the frame.

44. The assembly of claim 39, wherein the plurality of ceiling fan blades is covered by a one-piece covering.

45. The assembly of claim 39, wherein the length of each blade is approximately the same.

46. The assembly of claim 39, wherein the effective diameter of the frame member is in the range of from about 40 inches to about 120 inches.

47. A ceiling fan assembly, comprising:

means for defining a plurality of loops;

means for covering the plurality of loops to define a plurality of ceiling fan blades; and means for securing the plurality of loops to a fan motor.

48. The ceiling fan assembly of claim 47, wherein the covering means includes means for securing the covering means to the plurality of ceiling fan blades.

49. A method for providing a visual display, comprising securing a one-piece covering to a frame member so as to form a plurality of ceiling fan blades, wherein the covering provides a visual display.

50. The method of claim 49, wherein the frame member comprises one continuous frame member.

51. The method of claim 49, wherein the visual display comprises features selected from colors, letters, numbers, words, pictures, symbols, designs, or any combinations thereof.

52. The method of claim 49, wherein the visual display comprises advertising for a company, a product, or an event.

53. The method of claim 49, wherein the visual display provides decoration for a home, office, or an event.

54. A method for an advertiser to provide an advertisement in a location frequented by the public, comprising:

providing to the owner of the location a one-piece covering securable to a plurality of ceiling fan blades, wherein the covering provides an advertisement; and periodically sending a new covering to the owner of the location.

55. The method of claim 54, wherein the plurality of ceiling fan blades is defined by one continuous frame member.

56. The method of claim 54, further comprising providing to the owner of the location a ceiling fan assembly comprising one continuous frame defining a plurality of ceiling fan blades and a frame holder that positions the frame relative to a fan motor.

57. The method of claim 54, wherein the advertisement promotes a company, a product, an event, or any combination thereof.

58. The method of claim 54, wherein the location is selected from restaurants, bars, grocery stores, department stores, or sporting goods stores.

* * * * *